US006424309B1

(12) United States Patent
Johnston et al.

(10) Patent No.: US 6,424,309 B1
(45) Date of Patent: Jul. 23, 2002

(54) BROADBAND COMPACT SLOT DIPOLE/MONOPOLE AND ELECTRIC DIPOLE/MONOPOLE COMBINED ANTENNA

(75) Inventors: Ronald H. Johnston, Calgary (CA); Tin Chau Choi, Hong Kong (HK); Edwin Tung, Calgary (CA)

(73) Assignee: Telecommunications Research Laboratories, Edmonton (CA)

( * ) Notice: Subject to any disclaimer, the term of this patent is extended or adjusted under 35 U.S.C. 154(b) by 0 days.

(21) Appl. No.: 09/607,532

(22) Filed: Jun. 29, 2000

Related U.S. Application Data

(60) Provisional application No. 60/183,797, filed on Feb. 22, 2000.

(30) Foreign Application Priority Data

Feb. 18, 2000 (CA) ..... 2298991

(51) Int. Cl.[7] ..... H01Q 13/12; H01Q 21/00

(52) U.S. Cl. ..... 343/767; 343/725; 343/727; 343/795

(58) Field of Search ..... 343/725, 727, 343/729, 730, 767, 770, 793, 795, 752

(56) References Cited

U.S. PATENT DOCUMENTS

| | | | | | |
|---|---|---|---|---|---|
| 3,631,500 | A | * | 12/1971 | Itoh | 343/725 |
| 3,710,340 | A | | 1/1973 | Mayes | 343/725 |
| 4,443,802 | A | | 4/1984 | Mayes | 343/729 |
| 4,587,524 | A | * | 5/1986 | Hall | 343/729 |
| 4,684,953 | A | | 8/1987 | Hall | 343/725 |
| 4,710,775 | A | * | 12/1987 | Coe | 343/727 |
| 4,839,663 | A | * | 6/1989 | Kurtz | 343/771 |
| 4,899,165 | A | * | 2/1990 | Schadler | 343/767 |
| 5,402,132 | A | | 3/1995 | Hall et al. | 342/432 |

OTHER PUBLICATIONS

"Fundamental Limitations in Antennas", R.C. Hansen, Proceedings of the IEEE, vol. 69, No. 2, Feb. 1981, pp. 170–182.

"A Re–Examination of the Fundamental Limits on the Radiation Q of Electrically Small Antennas", James S. McLean, IEEE Transactions on Antennas and Propagation, vol. 44, No. 5, May 1996, pp. 672–676.

"Experimentally Determined Radiation Characteristics of Conical and Triangular Antennas", George H. Brown and O.M. Woodward, Jr., RCA Review, vol. 13, Dec. 1952, pp. 425–452.

"Asymmetrically Driven Antennas and the Sleeve Dipole", Ronold King, Proceedings of the I.R.E., vol. 38, Oct. 1950, pp. 1154–1164.

(List continued on next page.)

*Primary Examiner*—Tan Ho
(74) *Attorney, Agent, or Firm*—Pederson & Co., PLLC; Ken J. Pedersen; Barbara S. Pedersen

(57) ABSTRACT

A broadband compact antenna comprises an electric dipole or monopole coupled or connected in parallel to a slot antenna. The slot antenna is composed of a flat, square or rectangular conducting sheet with a slot having a variety of possible shapes including a bow-tie or rectangle. The slot is then fed at the center by a coaxial transmission line with its outer conductor bonded to the sheet. To obtain broadband characteristics and compactness, a dipole or monopole, formed using either wire, flat strips or shapes formed in sheets of metal, is located in close proximity to the center of the slot.

19 Claims, 16 Drawing Sheets

OTHER PUBLICATIONS

"Progress in Aircraft Aerials", R.A. Burberry, The Proceedings of the Institution of Electrical Engineers, vol. 109, Part B, No. 48, Nov. 1962, pp. 431–444.
"Aircraft antennas", J.V.N. Granger and J.T. Bolljahn, Proceedings of the IRE, vol. 43, May 1955, pp. 533–550.
"Antennas", J.D. Kraus, McGraw–Hill Inc., New York, 1988, Second Edition, pp. 632–642 from chapter 13 entitled "Slot, Horn and Complementary Antennas".
"The Monopole Slot: A Small Broad–Band Unidirectional Antenna", Paul E. Mayes, W.T. Warren, and F.M. Wiesenmeyer, IEEE Transactions on Antennas and Propagation, vol. 20, No. 4, Jul. 1972, pp. 489–493.
"The Monopole Slot as a Two–Port Diversity Antenna for UHF Land–Mobile Radio Systems", Benjamin M. Halpern and Paul E. Mayes, IEEE Transactions on Vehicular Technology, vol. VT–33, No. 2, May 1984, pp. 76–83.

* cited by examiner

BROADBAND COMPACT SLOT DIPOLE/MONOPOLE AND ELECTRIC DIPOLE/MONOPOLE COMBINED ANTENNA

RELATED APPLICATIONS

This application claims the priority of provisional application Serial No. 60/183,797 filed Feb. 22, 2000, and claims priority of Canadian application Ser. No. 2,298,991, filed Feb. 18, 2000.

FIELD OF THE INVENTION

The present invention relates generally to radio frequency antennas and, in particular, to broadband compact antennas for use in a communications apparatus.

BACKGROUND OF THE INVENTION

The increasing demand for multi-channel and broadband applications in wireless communications has necessitated the design of broadband antennas. With the current emphasis on antenna miniaturization, an antenna that possesses a wide impedance bandwidth, a compact structure and a high radiation efficiency is therefore very desirable. However, the design and construction of such an antenna are a significant challenge. Theoretical limitations exist in this endeavor [1, 2]. All references cited herein are listed at the end of this patent document and are incorporated herein by reference.

The designer of practical communications equipment that has wide consumer usage must pay careful attention to the ergonomics of the design of the units, such as the handsets. In general, the consumer requires increasingly more compact equipment that provides more functions. The antenna is a major limitation with respect to its size, its efficiency and its ability to cover a wide frequency range. In the near future, the handsets may be required to cover the cellular bands (800 to 900 MHz), the GPS (Global Positioning Satellite) frequency (1525 MHz), the PCS (Personal Communication System) band (1800 to 2000 MHz) and possibly higher frequency bands. A single antenna that can cover many frequency bands is much more desirable than multiple antennas that cover each frequency band individually. For the above reason, it is an object of the present invention to provide a highly efficient, compact antenna having a wide impedance bandwidth for use in a multi-channel or broadband communications apparatus.

A widely employed antenna on radio handsets and cellular phones is a quarter wave monopole mounted on the radio that uses the radio case (or circuit boards) as the equivalent of a small ground plane to provide a rough equivalent of a dipole antenna. The usage of a monopole on a ground plane and its equivalence to a dipole, is widely known. The fact that a radio case is used instead of a ground plane causes changes in the radiation pattern and input impedance of the antenna, but in most cases acceptable changes or recoverable changes (through minor modification to the monopole) are introduced. Due to the large variations in their input impedances with frequency, thin dipoles and monopoles are considered to be narrowband. Nevertheless, the impedance bandwidth of a dipole or monopole can be substantially broadened by increasing the thickness of the conductor. The well-known cylindrical and bow-tie (triangular) antennas are broadband variants of wire dipole and monopole antennas. A typical bow-tie antenna comprising two triangular sheet of conducting material is depicted in FIG. 1 [3]. To obtain a reduction in antenna size, a triangular sheet of metal can be placed over a ground plane conductor (as shown in FIG. 2) to form a equivalent monopole structure of the bow-tie antenna. Another broadband derivative of the dipole and monopole antennas are sleeve antennas. A sleeve dipole, formed by extending the inner and outer conductors of a coaxial line over a ground plane conductor, is shown in FIG. 3 and it has broadband properties superior to those of a half-wave or full-wave dipole [4]. FIGS. 4–6 [5, 6] illustrate some other varieties of a sleeve antenna.

A slot antenna is a complement of a dipole antenna with dimensions identical to the slot. Because of its low profile, slot antennas have many practical applications in wireless communications, especially where flush installations are needed. According to Babinet's principle [7], the radiation pattern of a slot antenna in an infinite conducting sheet is the same as that of the complementary dipole antenna, except that the electric and magnetic fields are interchanged. The input impedances of a slot antenna and its complementary dipole are related by $$Z_{slot}Z_{dip}=\eta^2/4 \tag{1}$$

where $Z_{slot}$ and $Z_{dip}$ are the input impedances of the slot antenna and the complementary dipole respectively, and $\eta$ is the intrinsic impedance of the surrounding medium ($=120\pi$ in free space). From the relationship as expressed by equation (1), it is evident that the input impedance of the slot antenna is inversely proportional to that of the complementary dipole, or vice versa. FIG. 7 depicts the input impedance of a typical dipole antenna, as a function of frequency, on a Smith Chart. The impedance curve of the complementary slot antenna is also shown in FIG. 8. By examining the two impedance spirals, it can be found that the slot antenna and the complementary dipole always have opposite reactances or susceptances. The dipole resonates, with a practical input impedance of roughly 70 ohms, when its electrical length is an odd number of half wavelengths, whereas the complementary slot is resonant and has a low input resistance when its electrical length is an even number of half wavelengths. Accordingly, if the slot antenna and the dipole are combined in some ways to form a single radiating structure, it is feasible to cause the input reactance or susceptance of the resulting antenna to be cancelled or reduced to some extend over a wide frequency range and to achieve a low input resistance across very wide bandwidths. The present invention thus employs both the slot antenna and the dipole or monopole antenna as the building blocks of the antenna structure and combines them together to achieve a wide impedance bandwidth and physical compactness. The slot antenna and the electric monopole or dipole antenna are connected together in a simple parallel connection or tight magnetic or electric coupling.

It is to be noted that an antenna made of a combined slot dipole and electric monopole connection has been disclosed by Mayes [8–11] using a more complex series and parallel connection of the elemental antennas. Variations of this antenna have been presented by Hall [12–14]. The basic structure of this group of antennas involves a microstrip line with two inputs or outputs mounted under the ground plane [8]. The slot is built into the ground plane to intercept ground currents flowing in the ground plane immediately above the "hot" conductor of the microstrip line. The slot antenna is therefore connected in series with the microstrip line. The monopole is connected in parallel to the microstrip line at a point coincident with the effective feed point of the slot antenna. The monopole emerges from below the ground plane through the slot. This antenna can produce a cardioid-like radiation pattern when fed on one of the transmission line arms and another cardioid-like radiation pattern oriented in the other direction when fed by the other transmission line arm. Variations of this antenna have been constructed by Hall [12] and by Mayes [11]. Four port extensions of this antenna have been developed by Mayes [11] and by Hall [13]. This antenna can be constructed to have a large bandwidth by terminating one of the transmission lines in a matched resistor [10]. This resistor will increase loss and lower the efficiency of the antenna however. The antenna described in this invention has a more simple connection of the electric monopole and the slot dipole and achieves large bandwidth without an efficiency reducing resistor. The simple connection of the slot and electric antennas permits a great range of electric monopole and dipole elemental antennas to be connected to a range of monopole and dipole slot antennas to provide a wide variety of combined antennas.

SUMMARY OF THE INVENTION

In accordance with an aspect of the present invention, a broadband compact antenna comprises an electric dipole or monopole coupled or connected in parallel to a slot antenna. In other aspects, the slot antenna is composed of a flat, square or rectangular conducting sheet with a slot having a variety of possible shapes including a bow-tie or rectangle. The slot is preferably fed at the center by a coaxial transmission line with its outer conductor bonded to the sheet. In another aspect, to obtain broadband characteristics and compactness, a dipole or monopole, formed using either wire, flat strips or shapes formed in sheets of metal, is located in close proximity to the center of the slot. In one embodiment of the present invention, a parasitic dipole is magnetically coupled to a slot antenna by placing a low dielectric spacer between the slot and the dipole. The spacer allows maximum coupling between the slot and the dipole, while preventing a direct electrical contact of the two elements. The parasitic dipole and the slot are oriented so that the polarizations of the two elements are identical. In another embodiment of the present invention, a dipole or monopole is connected to the center of a slot antenna and both antennas are energized by a common coaxial feed. The dipole or monopole is positioned in a plane at an angle or normal to that of the slot antenna. Practical and commercially available shielded (i.e., coaxial) transmission lines have characteristic impedances that cover a relatively small range of values, for example 50 to 75 ohms. Broadband antennas must have an impedance that matches these transmission lines for maximum practical application. Thus, the input impedance of a broadband antenna must be roughly in the range of 50 to 75 ohms. The electrical dipole antenna has input resistances of approximately 70 ohms when its electrical length is an odd number of half wavelengths and has high resistances when its electrical length is an even number of half wavelengths. The slot antenna can be made (by selection of its width) to have input resistances in the 50 to 75 Ω range when its electrical length is an even number of half wavelengths. The input resistances of the slot antenna are high when the slot is an odd number of half wavelengths long. Hence, if the electric dipole and the slot antenna is connected together in parallel, the element with the smaller impedance will dominate and it is practicable to reduce the input impedance of the resulting antenna to a resistance in the 50 to 75 Ω range whenever the two elements are a integral multiple of half wavelength long. At intermediate frequencies, the input reactances or susceptances of the two elements will tend to cancel each other out and the resulting antenna will possess an input impedance of value that is within the practical range. It has been found that, with the above arrangements, a highly efficient, broadband compact antenna, suited for use in hand-portables or other communications equipment, can be achieved by varying the relative dimensions and shapes of the slot and the dipole or monopole. The combination of the slot and dipole or monopole antennas is therefore a more effective radiator than either one alone.

BRIEF DESCRIPTION OF THE DRAWINGS

There will now be described preferred embodiments of the invention, with reference to the Figures, by way of example and without intending to limit the generality of the invention, in which like reference characters denote like elements, and in which.

DETAILED DESCRIPTION OF PREFERRED EMBODIMENTS

Figure 1:
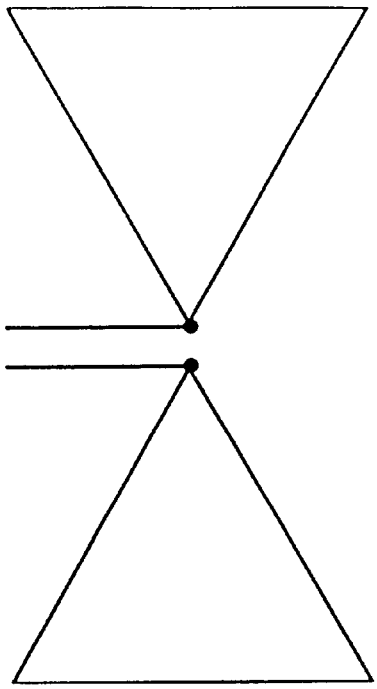
PRIOR ART FIG. 1
FIG. 1 is a side view of a bow-tie antenna.
Figure 2:
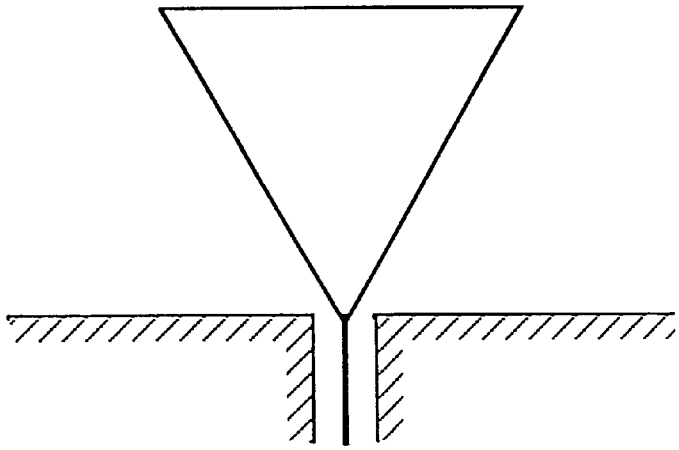
PRIOR ART FIG. 2
FIG. 2 is a side view of a triangular antenna mounted upon a ground plane conductor.
Figure 3:
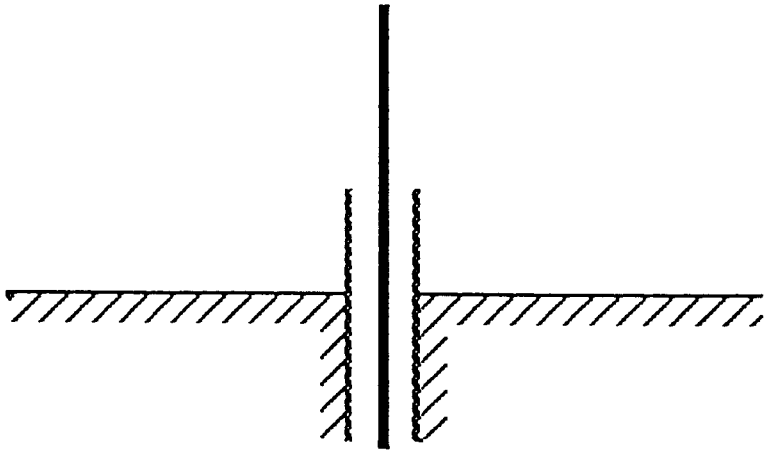
PRIOR ART FIG. 3
FIG. 3 is a side view of a sleeve dipole antenna.
Figure 4:
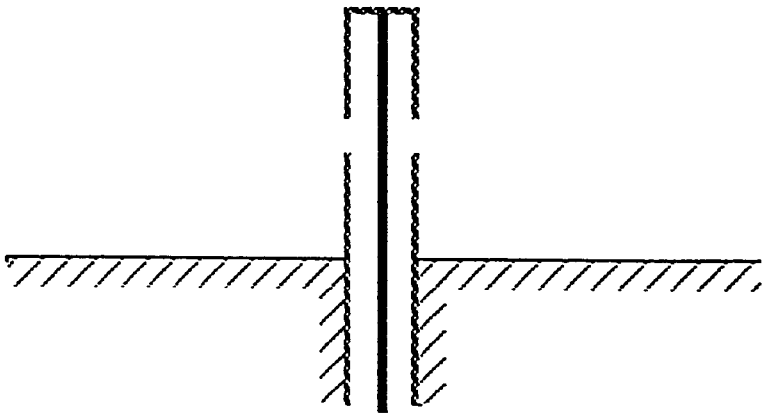
PRIOR ART FIG. 4
FIG. 4 is a side view of a broadband sleeve antenna.
Figure 5:
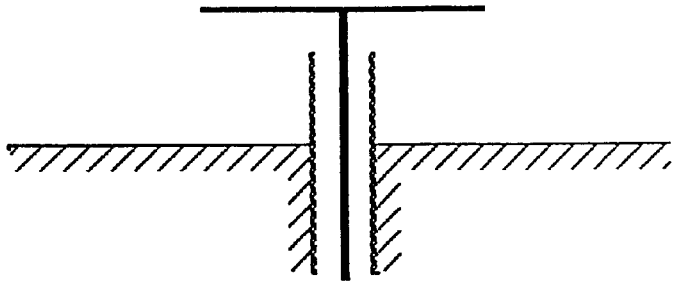
PRIOR ART FIG. 5
FIG. 5 is a side view of a top-loaded sleeve antenna.
Figure 6:
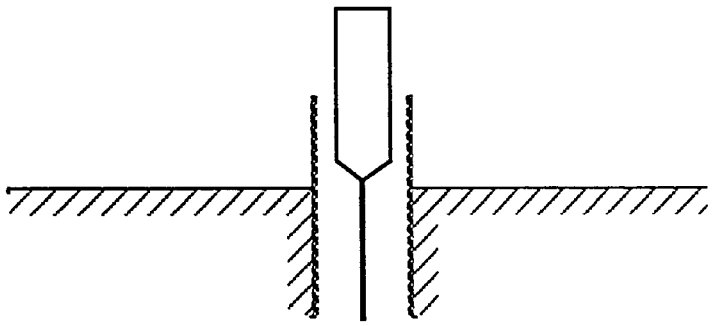
PRIOR ART FIG. 6
FIG. 6 is a side view of a partial sleeve aerial for use in an aircraft.
Figure 7:
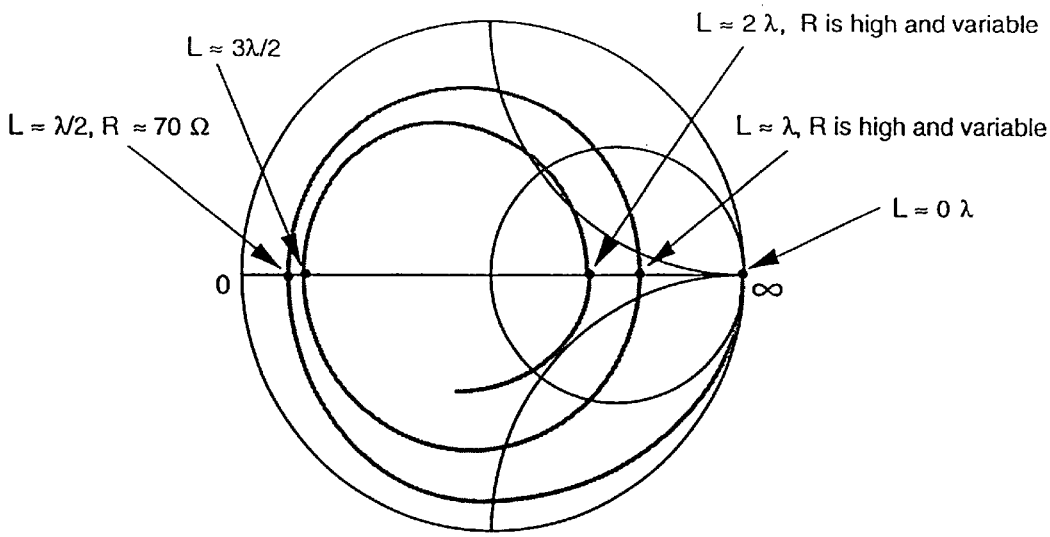
FIG. 7 is a graph illustrating the input impedance of a dipole antenna as a function of frequency.
Figure 8:
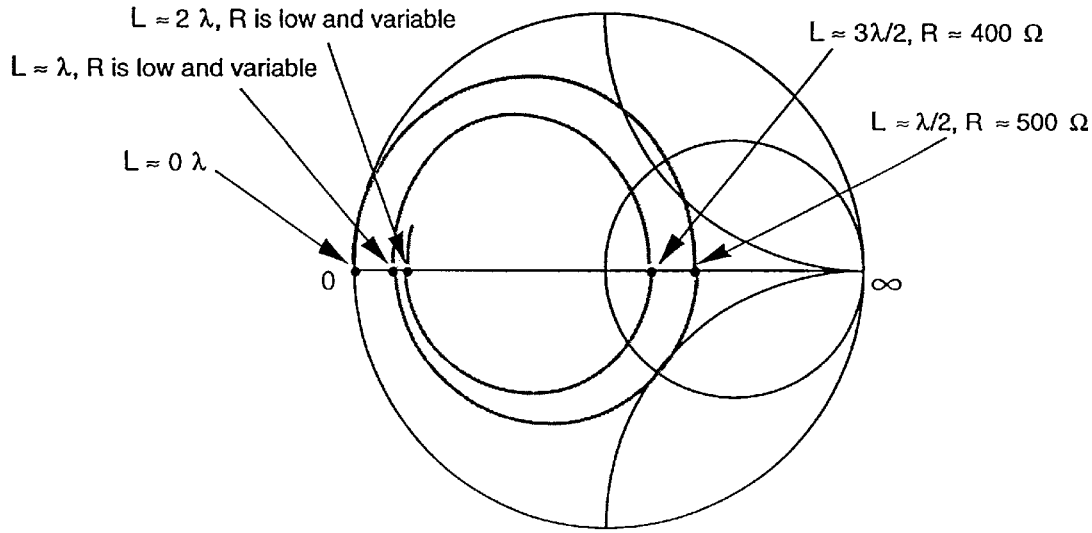
FIG. 8 is a graph illustrating the input impedance of a slot antenna as a function of frequency.
Figure 9A:
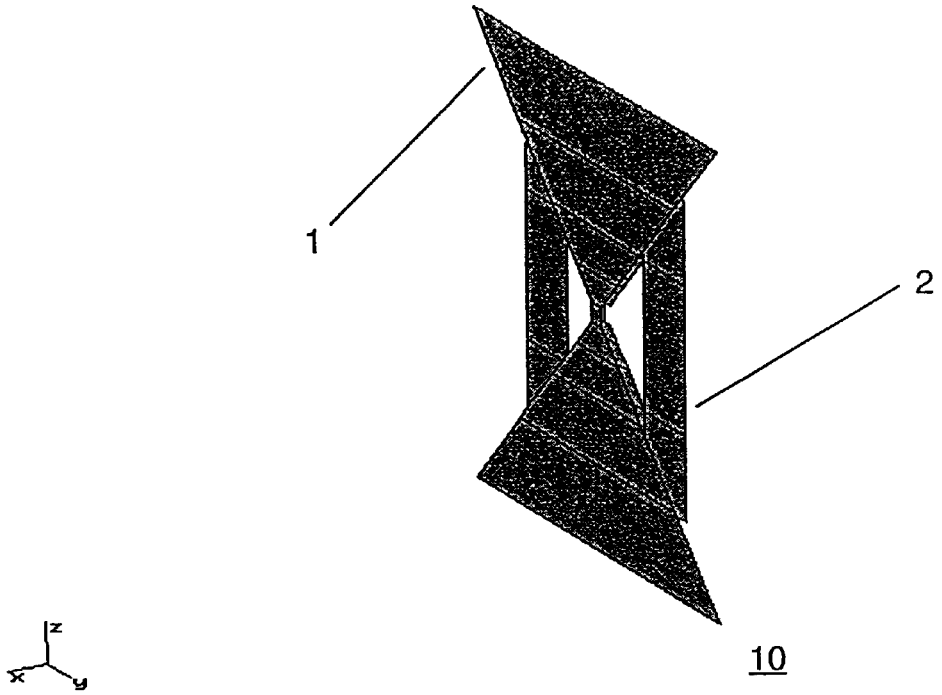
FIG. 9A is an isometric view of the first preferred embodiment of the present invention.
Figure 9B:
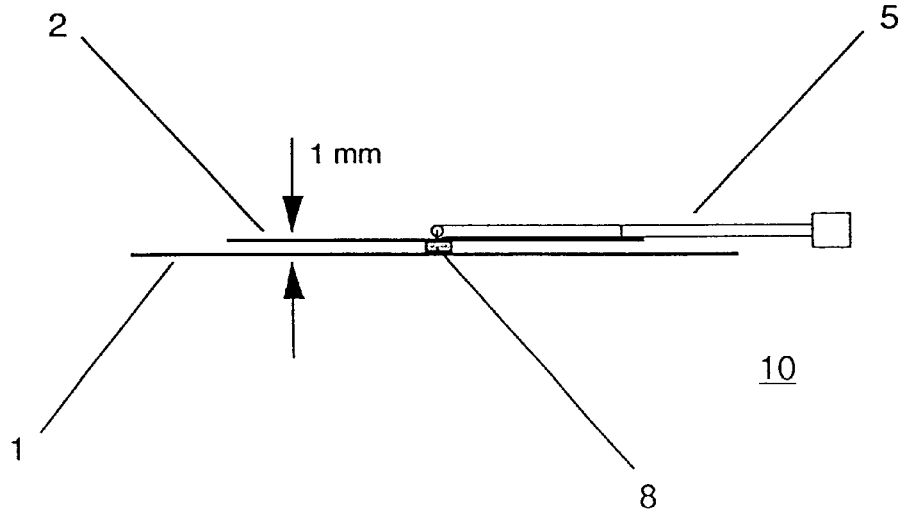
FIG. 9B is a top view of the first preferred embodiment of the invention.
Figure 10A:
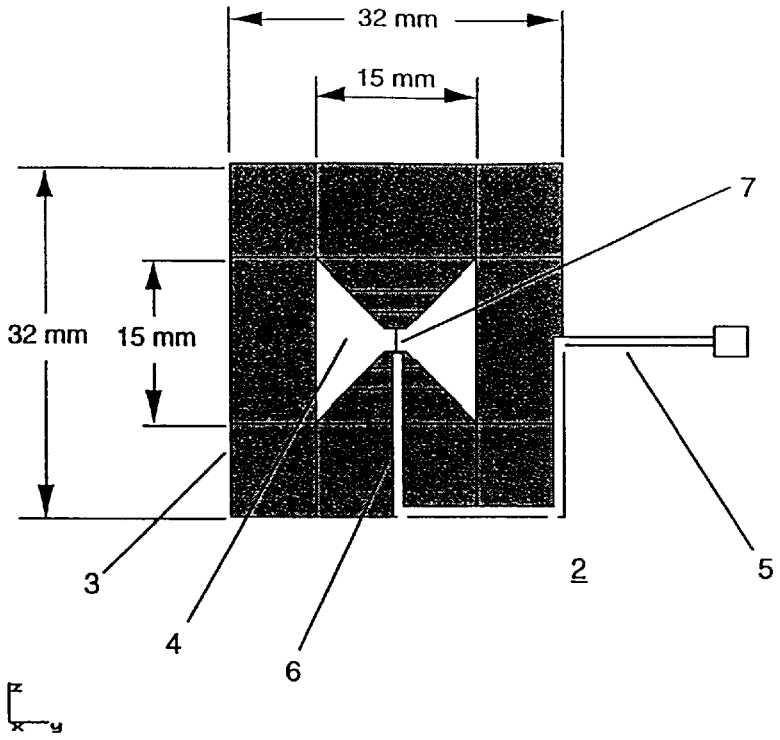
FIG. 10A is a side view of the slot antenna element.

Referring to FIGS. 9A & 9B, a compact broadband antenna 10 is shown comprising a parasitic dipole 1, located in close proximity to the center of a slot antenna 2. The slot antenna 2 (as shown in FIG. 10A) is composed of a flat, square conducting sheet 3 (here comprising copper) with a slot 4 having a shape of a bow-tie, at the center of the sheet 3. The bow-tie slot 4 has a flare angle of 90°. The slot 4 is energized at the center and coupled to an RF (radio frequency) feed, a coaxial transmission line 5. As depicted in FIG. 10A, the outer conductor 6 of the coaxial transmission line 5 is bonded to the conducting sheet 3 on one side of the slot 4, such as by soldering, while the inner conductor 7 of the line 5 is connected to the other side of the slot 4. The transmission line 5 is bent and wrapped around the edges of the conducting sheet 3, so that the electric field of the antenna 2 will not induce any current flow on the coaxial line 5. Besides, a plane of zero potential that is normal to the conducting sheet 3 and passes through the slot 4, is created so as to make the transformation of the entire antenna structure 10 into an equivalent monopole structure feasible.

Figure 10B:
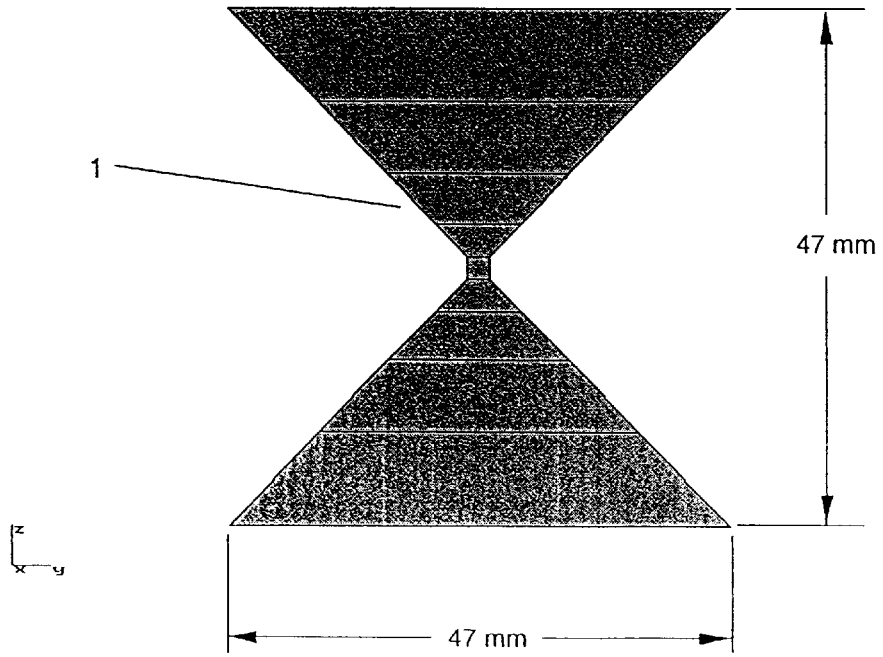
FIG. 10B is a side view of the dipole antenna element.

As shown in FIG. 10B, in the preferred embodiment, the parasitic dipole 1 comprises a flat sheet of conducting material (here comprising copper) possessing a shape of a bowtie with a flare angle of 90°. To achieve broadband characteristics, the parasitic dipole 1 is approximately three times larger in length and width than the slot 4. The center of the dipole 1 is positioned in close proximity to the center of the slot 4 and the two elements 1 & 2 are separated by a low dielectric spacer 8 (FIG. 9B). The dielectric spacer 8 prevents direct electrical contact between the two elements 1 & 2, while maintaining a maximum magnetic and electric coupling between the two elements 1 & 2. The dipole 1 and the slot 4 are oriented so that the polarizations of the two elements 1 & 2 are identical. With the coaxial feed 5 located as illustrated in FIG. 10A, a potential difference is created across the slot 4 and current will flow from the higher potential side of the slot 4 to the lower potential side, around the edges of the slot 4. As a result, a magnetic flux will be created within the slot 4. The magnetic flux will encircle the parasitic dipole 1 and thus induce a current flow on the dipole 1. It has been found that, with the arrangement and configuration discussed above, the impedance bandwidth of the resulting antenna 10 is very substantial.

Figure 11:
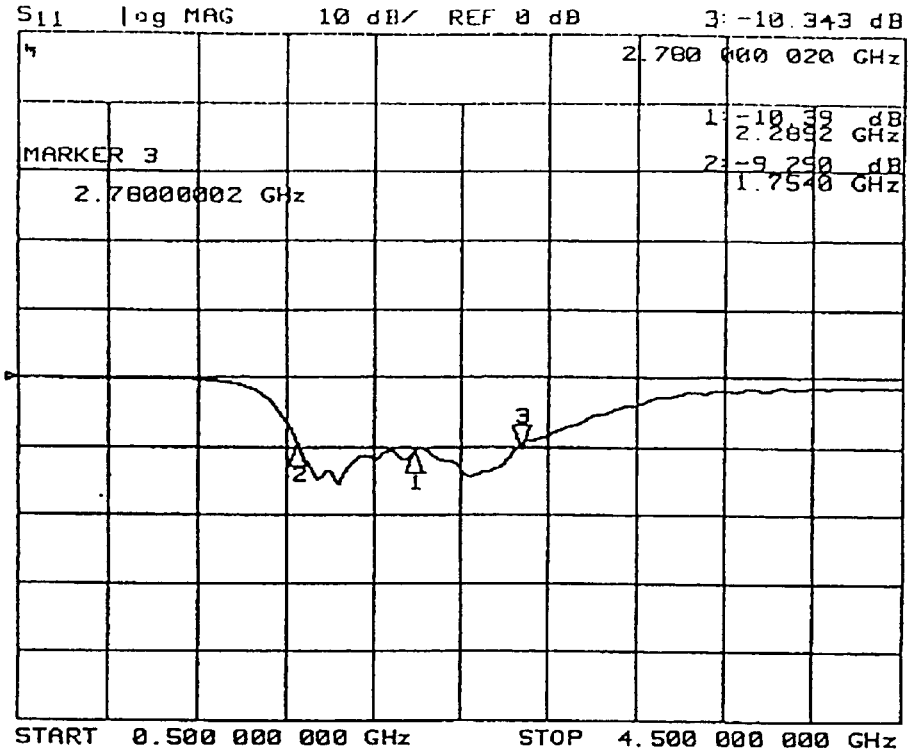
FIG. 11 is a graph illustrating the return loss of the first preferred embodiment of the invention.
Figure 12:
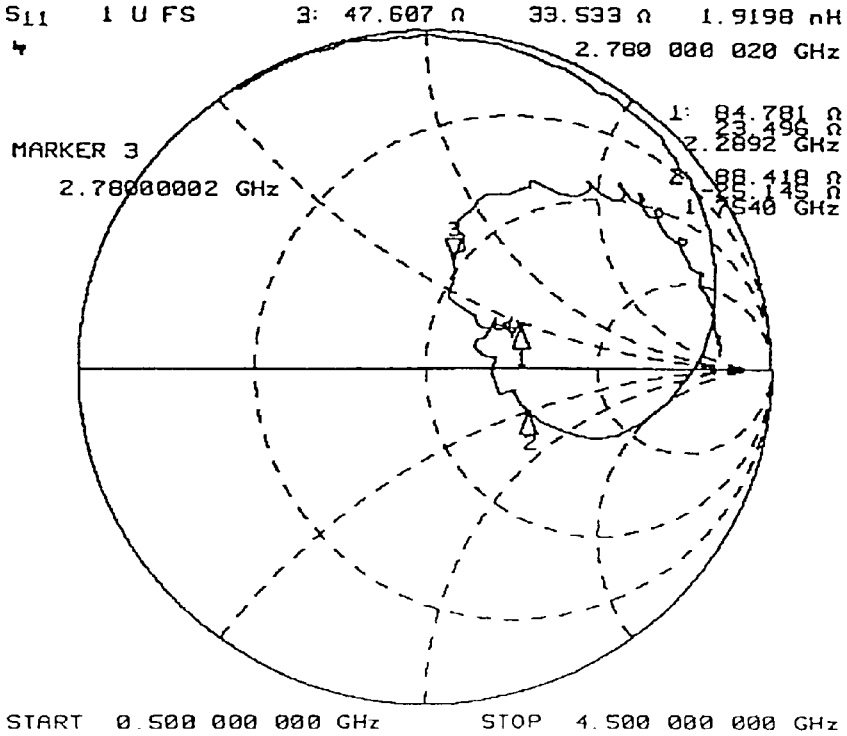
FIG. 12 is a graph illustrating the input impedance of the first preferred embodiment of the invention.
Figure 13:
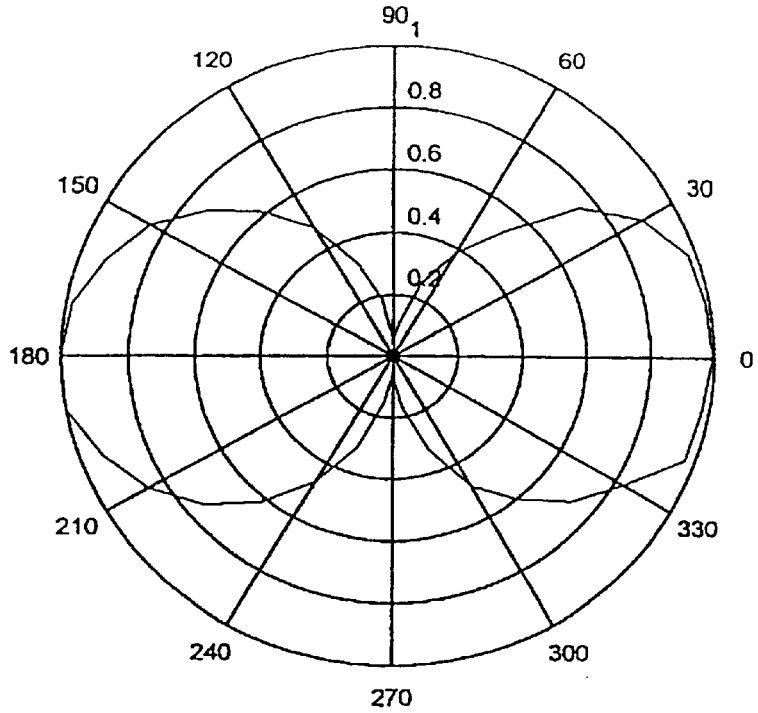
FIG. 13 is a graph illustrating the radiation pattern of the first preferred embodiment of the invention.

FIG. 11 shows the return loss of the antenna 10 over a frequency range of 0.5 to 4.5 GHz. The antenna has a 10 dB return loss bandwidth of over 1 GHz from 1.76 to 2.78 GHz. In addition, the bandwidth ratio for voltage standing wave ratio (VSWR)<2 is found to be about 1:1.6. FIG. 12 illustrates the input impedance of the antenna 10 from 0.5 to 4.5 GHz on a Smith Chart. From FIG. 12, it is apparent that the antenna 10 has a medium value of resistance and a small value of reactance over a wide frequency range. The azimuth, horizontal polarization field pattern of the antenna 10 at 1.8 GHz is depicted in FIG. 13. The radiation pattern is found to be bidirectional with maxima at 0° and 180°, and minima at 90° and 270°.

Figure 14:
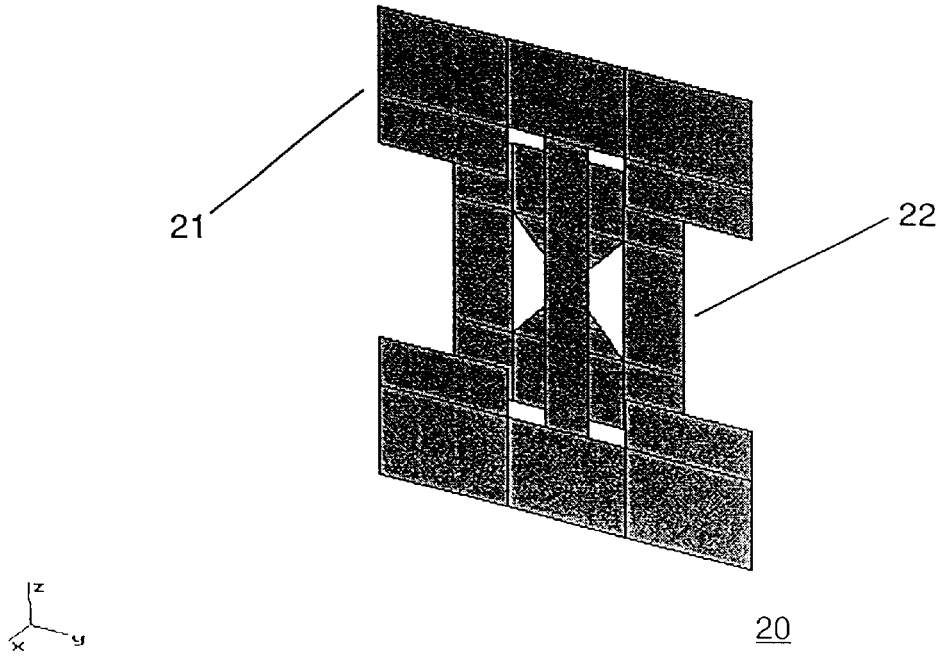
FIG. 14 is an isometric view of the second preferred embodiment of the invention.
Figure 15:
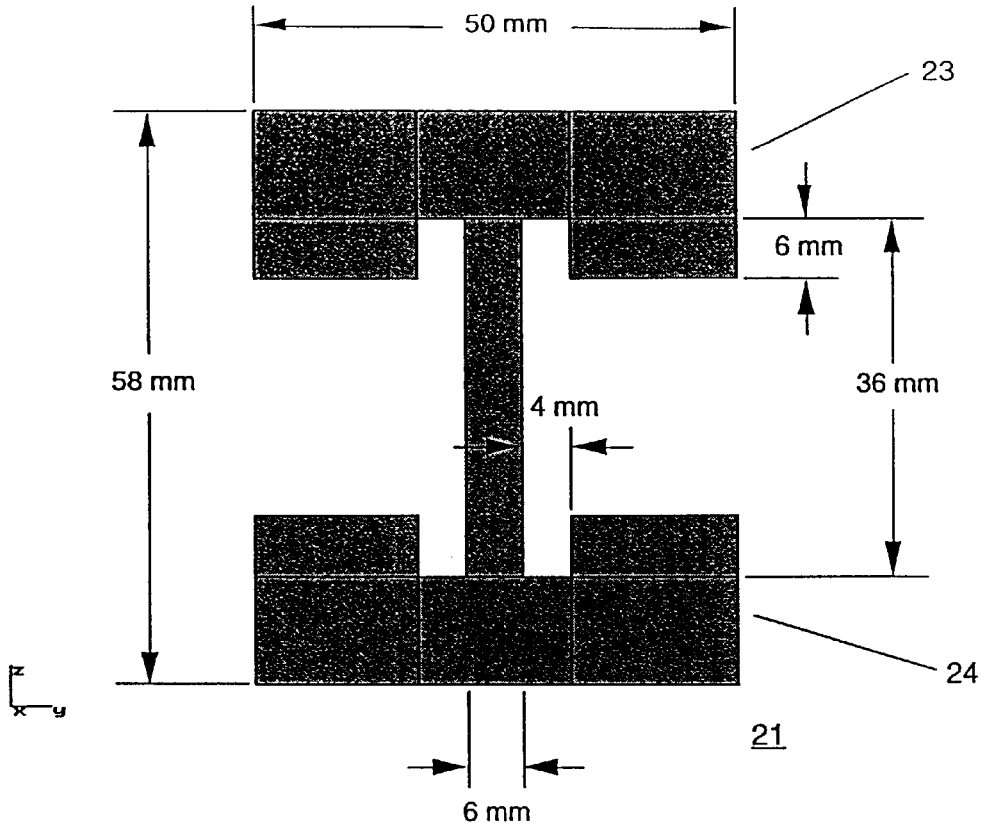
FIG. 15 is a side view of the dipole antenna element.

To further enhance the broadband characteristics of the antenna 10, the parasitic bow-tie dipole 1 shown in FIG. 10B is replaced by a top-loaded strip dipole, and FIG. 14 discloses another preferred embodiment of the present invention. As illustrated in FIG. 14, the parasitic dipole 21 of the antenna 20 is formed using a flat strip of conducting material (here comprising copper). In order to achieve compactness, the parasitic dipole 21 (as shown in FIG. 15) further comprises two capacitive plates or hats 23 & 24 located at the ends of the strip, giving a shape of a letter 'H' to the dipole 21. The capacitive hats 23 & 24 are utilized to reduce the frequency of the lower operating frequency point. In the preferred embodiment, the separation between the slot antenna 22 and the dipole 21 is reduced, when compared to that of the antenna 10, to attain a wide impedance bandwidth. Despite the above modifications, the configuration and dimensions of the slot antenna, as well as the feeding arrangement, remains the same as the antenna 10.

Figure 16:
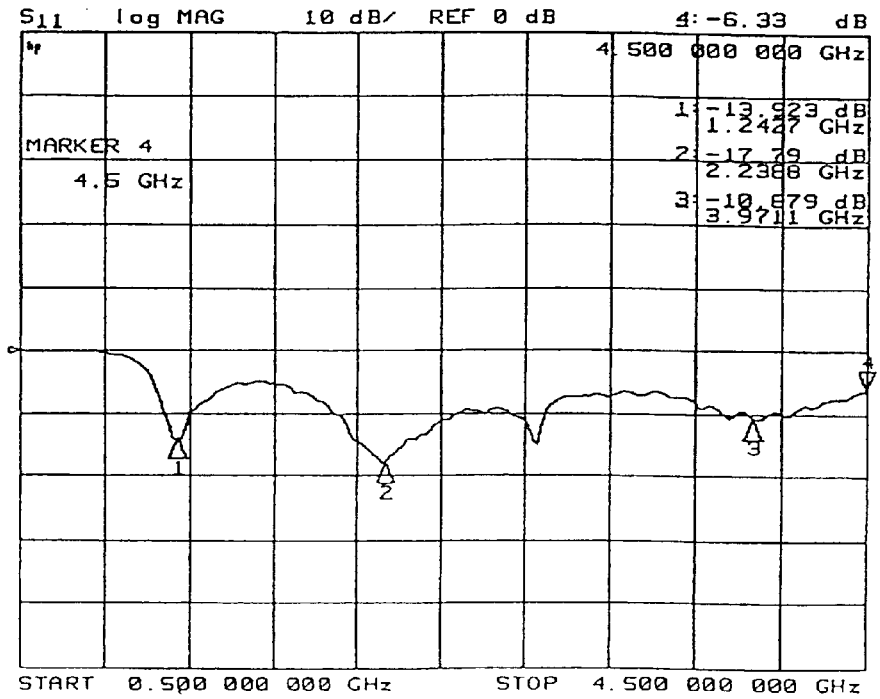
FIG. 16 is a graph illustrating the return loss of the second preferred embodiment of the invention.
Figure 17:
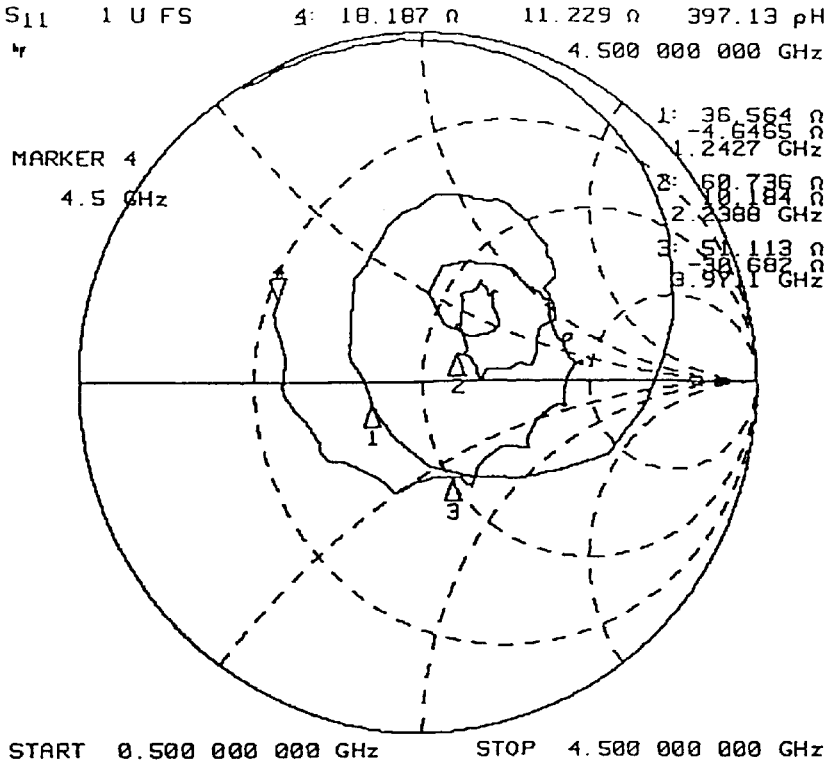
FIG. 17 is a graph illustrating the input impedance of the second preferred embodiment of the invention.
Figure 18:
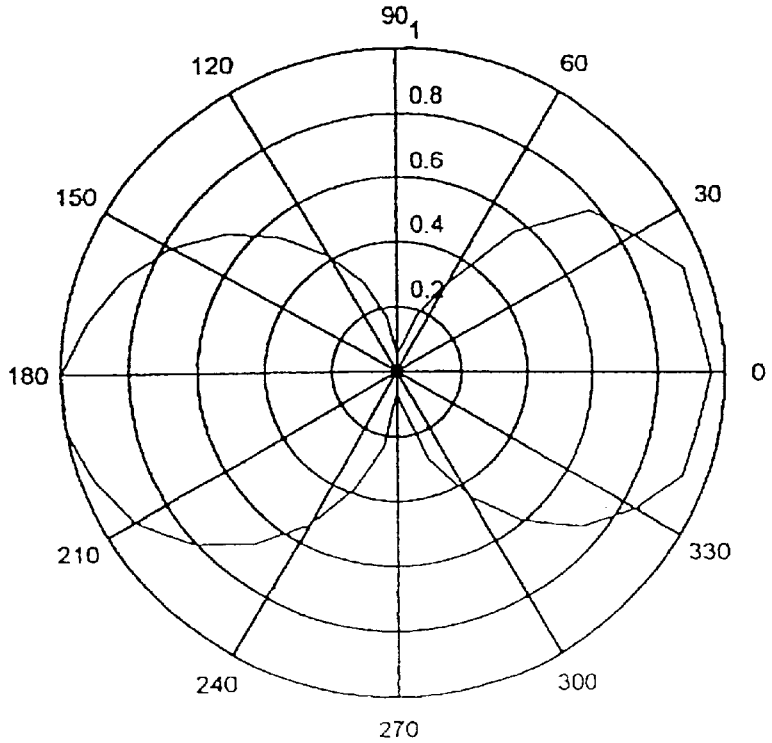
FIG. 18 is a graph illustrating the radiation pattern of the second preferred embodiment of the invention.

FIG. 16 shows the return loss of the antenna 20 over a frequency range of 0.5 to 4.5 GHz. The antenna 20 has a 10 dB return loss bandwidth of over 2.8 GHz from 1.15 to 3.97 GHz. Besides, the bandwidth ratio for VSWR<2 is found to be around 1:3.5. Hence, the antenna 20 possesses a more broadband characteristics than the antenna 10. FIG. 17 illustrates the input impedance of the antenna 20 from 0.5 to 4.5 GHz on a Smith Chart. As indicated in FIG. 17, the impedance curve loops around the center of the Smith Chart several times, which implies that there are multiple resonances in this frequency range and the antenna 20 is very broadband. The azimuth, horizontal polarization field pattern of the antenna 20 at 1.8 GHz is depicted in FIG. 18. The radiation pattern is found to be bidirectional with maxima at 0° and 180°, and minima at 90° and 270°.

Figure 19:
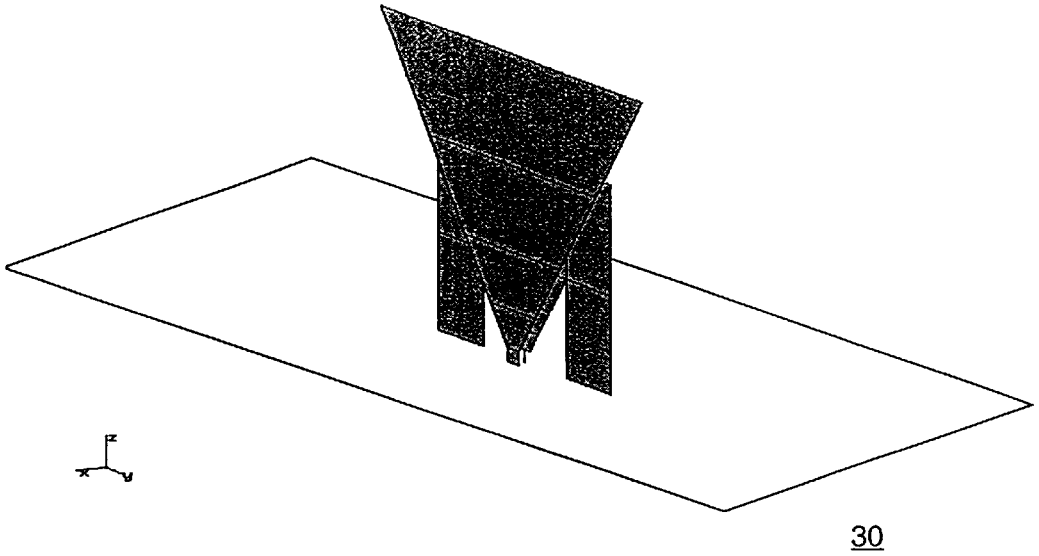
FIG. 19 is an isometric view of the equivalent monopole structure of the first preferred embodiment of the invention.
Figure 20:
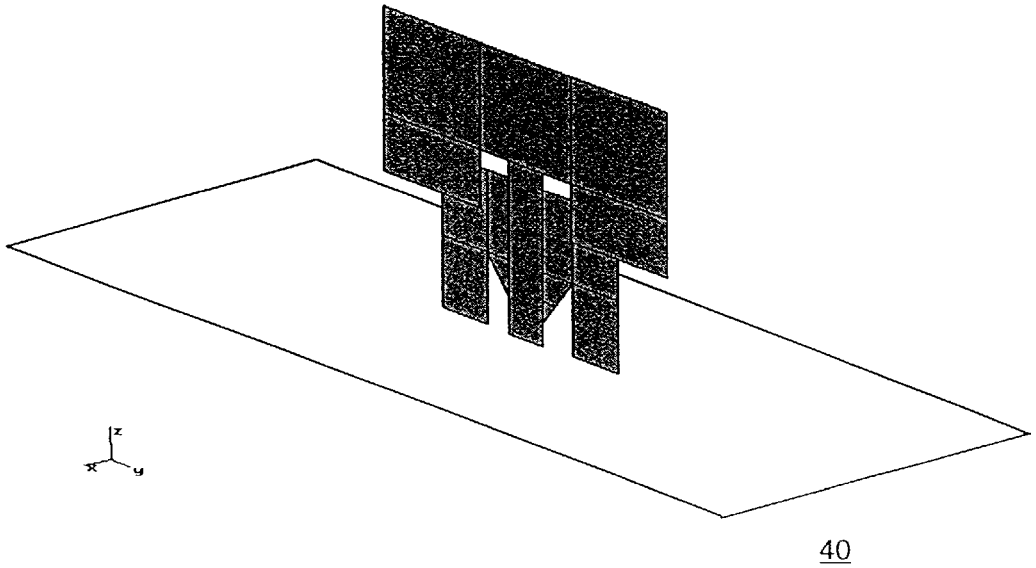
FIG. 20 is an isometric view of the equivalent monopole structure of the second preferred embodiment of the invention.

The broadband antennas 10 & 20 can be transformed into their equivalent monopole structures that are more practical and small enough to fit into many portable communications devices requiring broadband operations. FIGS. 19 & 20 show the equivalent monopole structures of the broadband antennas 10 & 20 respectively. In each case, half of the broadband antenna is removed and is placed upon a ground conducting plane to obtain a monopole equivalent using the image theory. The resulting antenna structures 30 & 40 (FIGS. 19 & 20) are easier to feed (does not require bending of the coaxial transmission line) and have a better isolation to the rest of the electronic circuitry due to the presence of the ground plane conductor.

Figure 21:
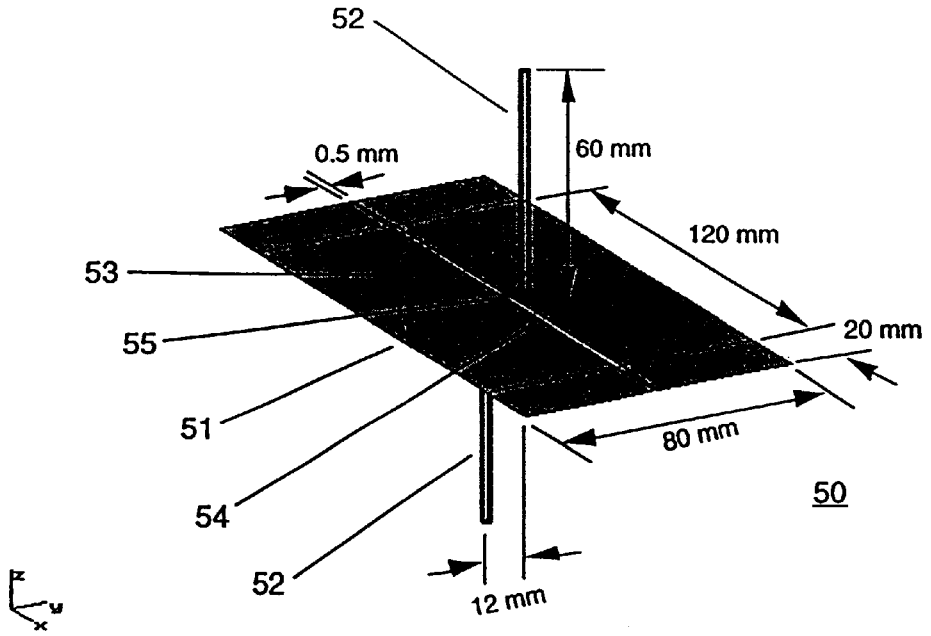
FIG. 21 is an isometric view of the third preferred embodiment of the invention.
Figure 22:
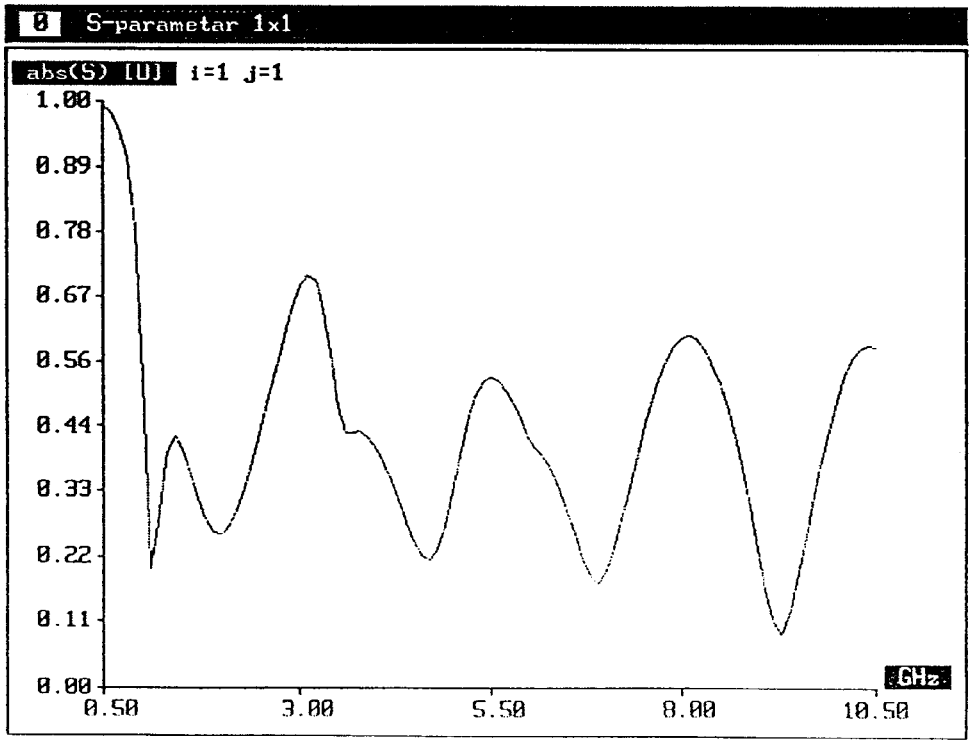
FIG. 22 is a graph illustrating the return loss of the third preferred embodiment of the invention.

For the resulting antenna to acquire a wide impedance bandwidth, the slot antenna and the dipole may be connected together in parallel, instead of magnetically coupled to each other. A series connection between the slot antenna and the dipole is not used as the input impedance of the resulting antenna would be too high for the antenna to be practical for most applications. The slot antenna may be magnetically or electrically connected (indirect coupling) or may be directly connected electrically to the antenna element forming the electric dipole or monopole. FIG. 21 discloses another preferred embodiment of the present invention, in which a slot antenna is directly connected to a dipole antenna. The broadband antenna 50, as shown in FIG. 21, consists of a slot antenna 51 connected in parallel with a dipole antenna 52. The slot antenna 51 is composed of a flat, rectangular conducting sheet 53 (here comprising copper) with a slot 54 having a shape of a rectangle. The dipole antenna 52 comprises two flat strips of conducting material (here comprising copper) with each connected to one side of the conducting sheet 53, such as by soldering, in close proximity to the center of the slot 54. The dipole antenna 52 is oriented in a plane normal to that of the conducting sheet 53. Both the slot 54 and the dipole 52 are energized at the center by a common coaxial feed 55. FIG. 22 shows the return loss of the antenna 50 over a frequency range of 0.5 to 10.5 GHz. The antenna 50 is very broadband and has a return loss of more than 3 dB from 0.9 to above 10.5 GHz.

Figure 23:
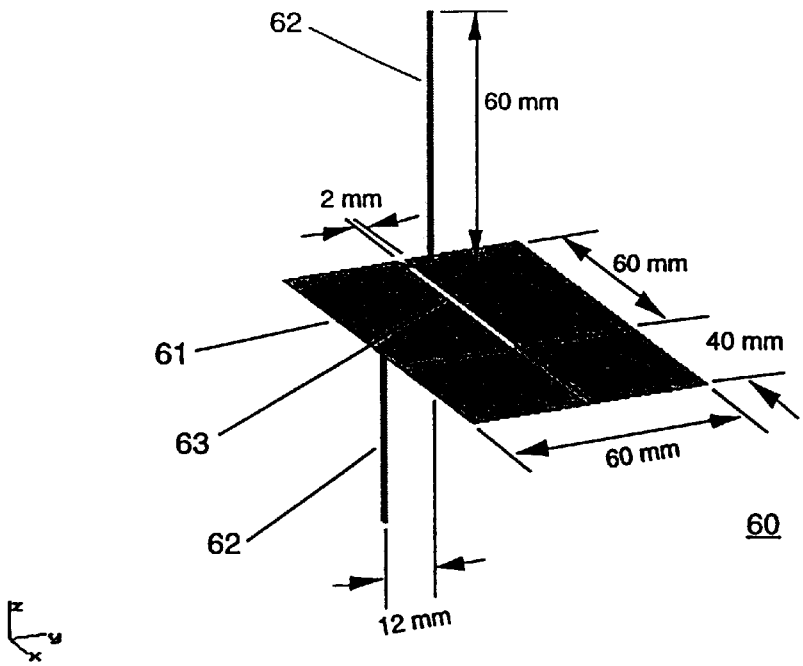
FIG. 23 is an isometric view of the fourth preferred embodiment of the invention.
Figure 24:
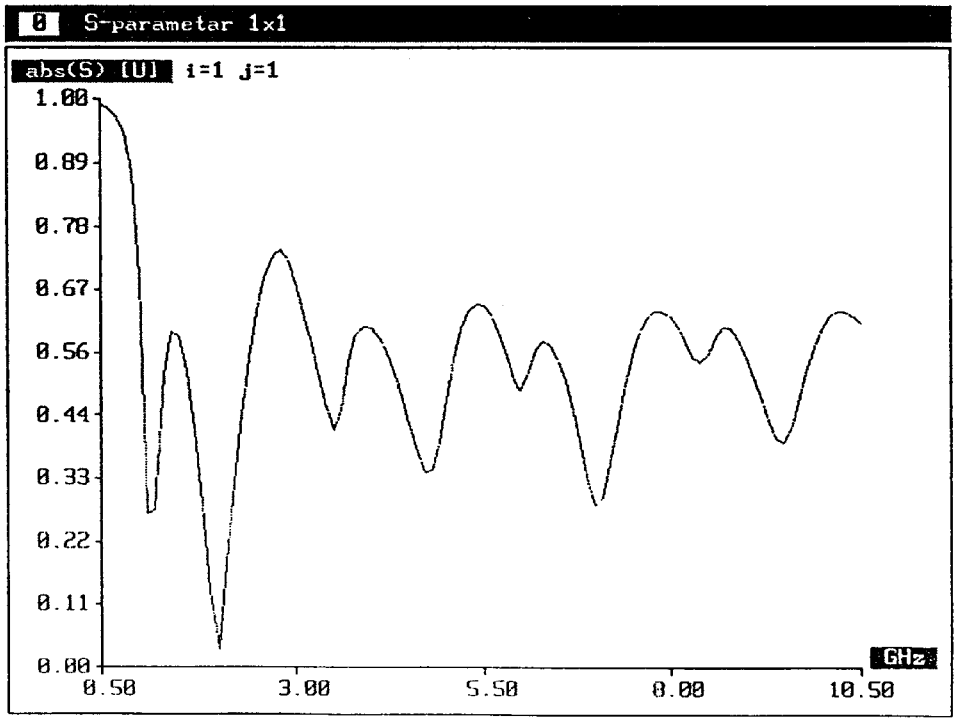
FIG. 24 is a graph illustrating the return loss of the fourth preferred embodiment of the invention.

FIG. 23 depicts a modified version of the broadband antenna 50, in which half of the slot antenna is removed to attain a further reduction in antenna size. The width of the slot 63 in the broadband antenna 60 (as shown in FIG. 23) is increased, when compared to that of the antenna 50, to acquire optimum performance. FIG. 24 illustrates the return loss of the antenna 60 over a frequency range of 0.5 to 10.5 GHz. The antenna 60 has a 3 dB return loss bandwidth of at least 1.63 GHz from 0.97 to 2.6 GHz and from 2.93 to above 10.5 GHz. The combination of a half slot antenna 61 and a dipole 62 (FIG. 23) thus gives a significant reduction in antenna size, while retaining the broadband characteristics of the resulting antenna 50.

Figure 25:
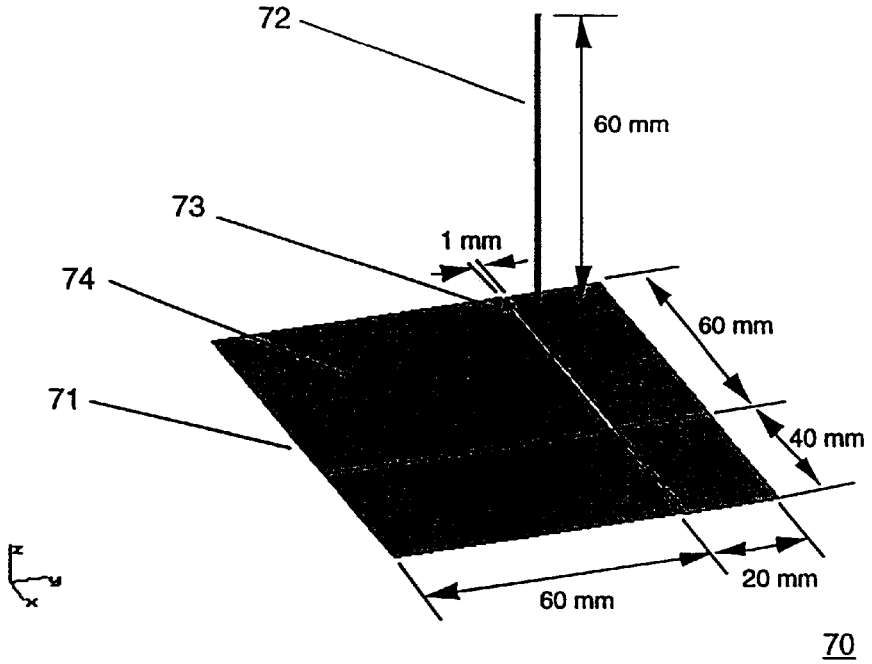
FIG. 25 is an isometric view of the fifth preferred embodiment of the invention.
Figure 26:
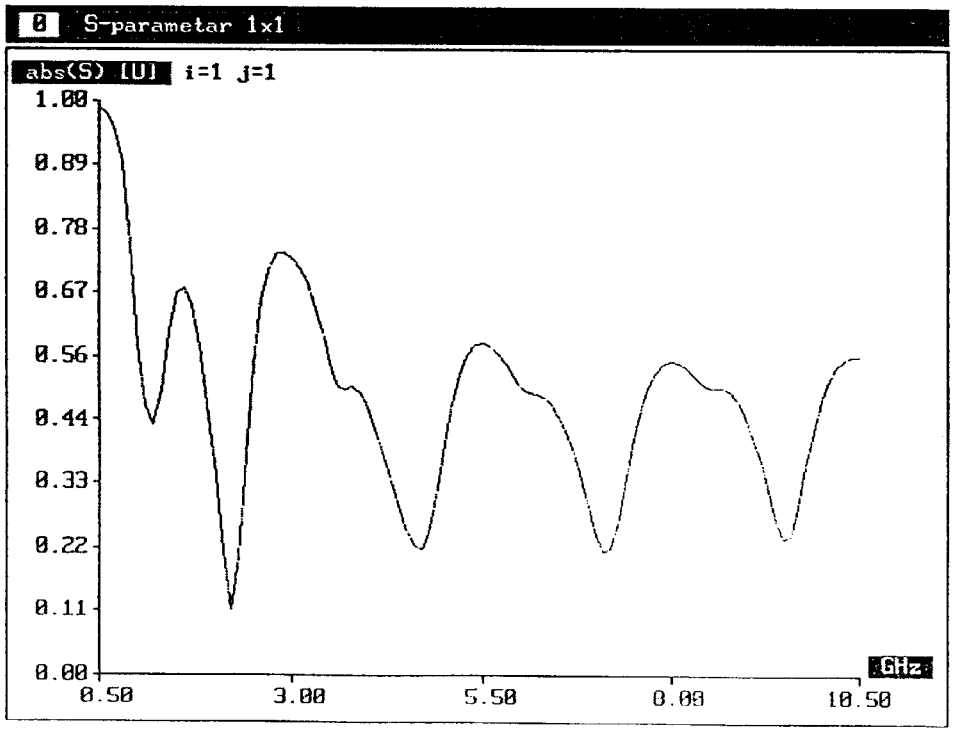
FIG. 26 is a graph illustrating the return loss of the fifth preferred embodiment of the invention.

FIG. 25 reveals another preferred embodiments of the present invention where a monopole antenna is connected in parallel with a quarter-wave slot antenna. As shown in FIG. 25, the broadband antenna 70 is a modified version of the antenna 60 and a further reduction in antenna size is achieved by removing part of the conducting sheet of the slot antenna 61 in the antenna 60. The monopole antenna 72 is located in close proximity to the RF feed 73 that excites the quarter-wave slot antenna 71, on the narrower side of the conducting sheet 74. The monopole antenna 72 is oriented in a plane normal to the slot antenna 71. FIG. 26 depicts the return loss of the antenna 70 over a frequency range of 0.5 to 10.5 GHz. The antenna 70 has a 3 dB return loss bandwidth of at least 1.77 GHz from 0.91 to 2.68 GHz and from 3.1 to above 10.5 GHz.

Figure 27:
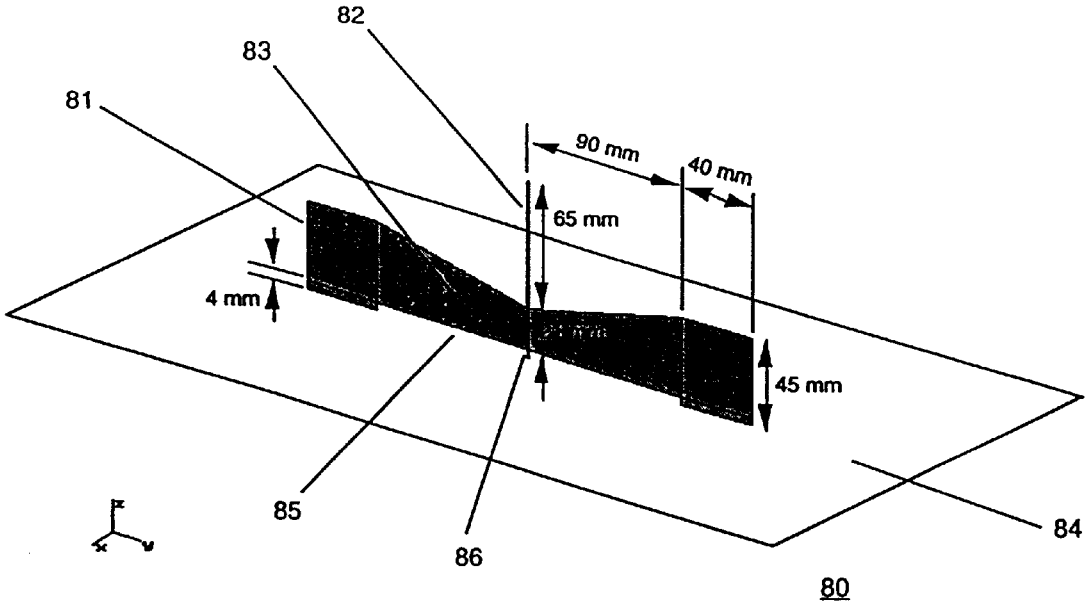
FIG. 27 is an isometric view of the sixth preferred embodiment of the invention.
Figure 28:
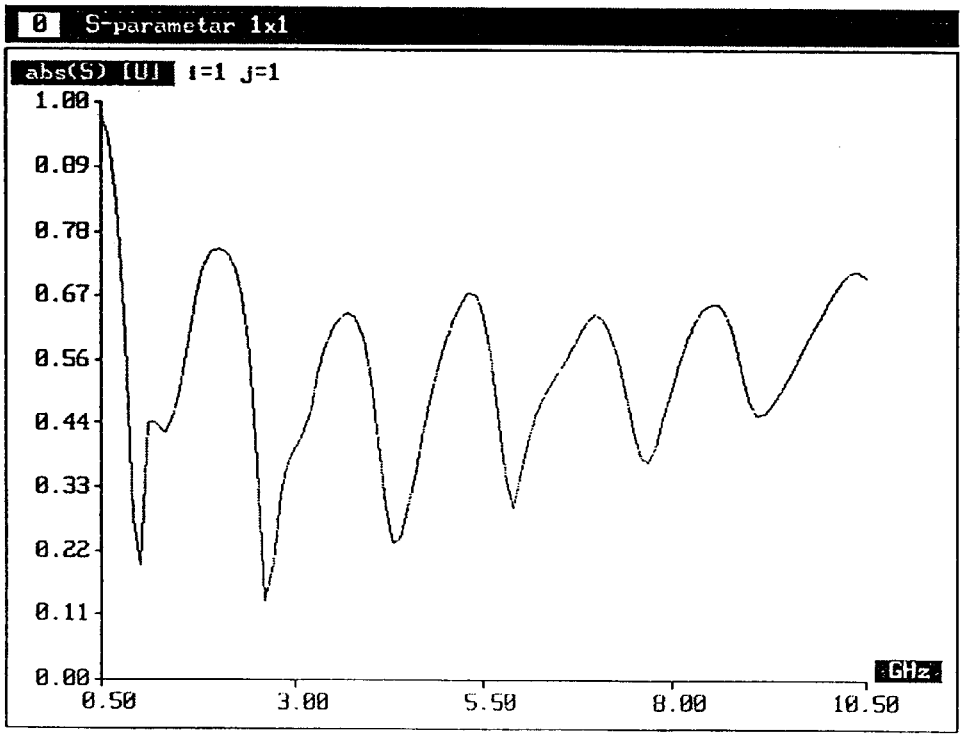
FIG. 28 is a graph illustrating the return loss of the sixth preferred embodiment of the invention.
Figure 29:
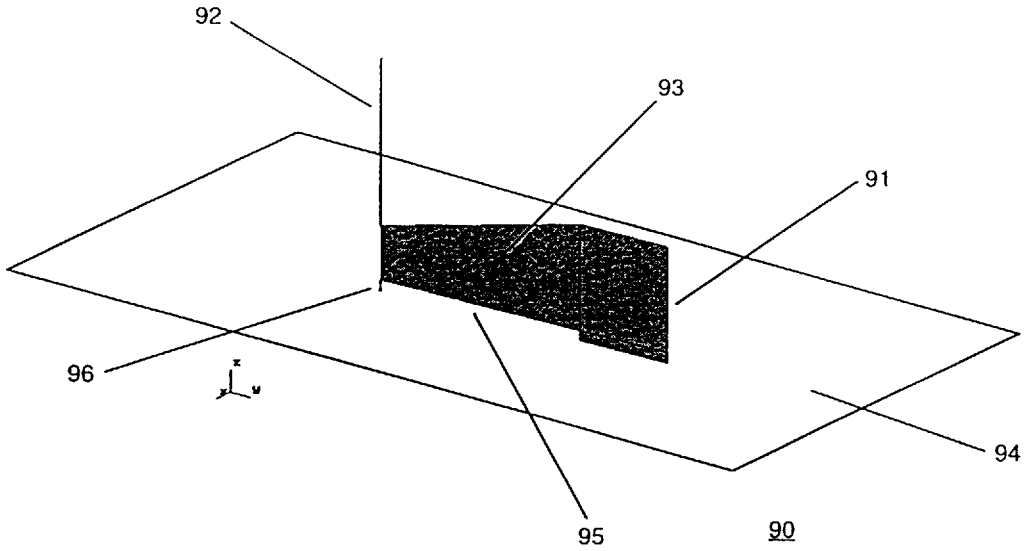
FIG. 29 is an isometric view of the seventh preferred embodiment of the invention.

FIG. 27 shows another preferred embodiment of the present invention, in which a monopole antenna is connected to the top edge of a half slot antenna mounted upon a ground plane conductor. The half slot antenna 81, as illustrated in FIG. 27, comprises a 'M' shaped conducting sheet 83 placed on top of a ground plane conductor 84. The conducting sheet 83 is positioned in a plane normal to that of the ground plane conductor 84 and has a rectangular slot 85 located at the bottom end of the sheet 83. The monopole antenna 82 is connected to the center of the top edge of the slot antenna 81 and is oriented in the same plane as the slot antenna 81. Both the slot antenna 81 and the monopole antenna 82 are excited by a common RF feed 86 located at the center of the slot 85. FIG. 28 depicts the return loss of the antenna 80 over a frequency range of 0.5 to 10.5 GHz. The antenna 80 has a 3 dB return loss bandwidth of at least 1 GHz from 0.72 to 1.76 GHz and from 2.21 to above 10.2 GHz. To obtain a further reduction in antenna size, half of the slot antenna 81 can be removed to form another broadband antenna 90, as illustrated in FIG. 29.

Figure 30:
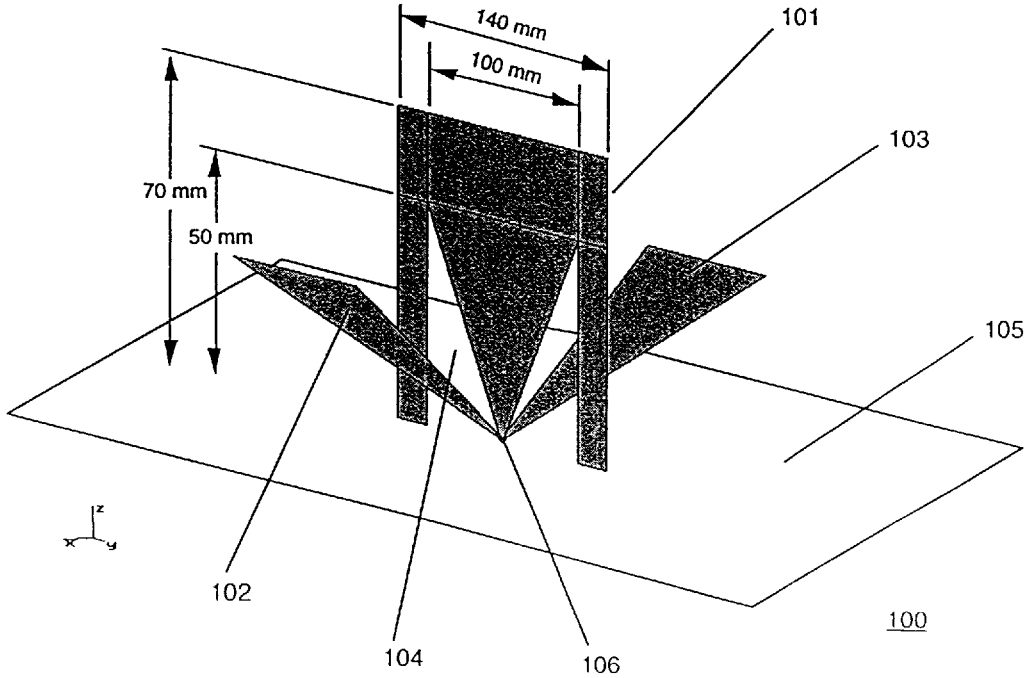
FIG. 30 is an isometric view of the eighth preferred embodiment of the invention.

FIG. 30 discloses yet another preferred embodiment of the present invention where two triangular antennas are connected directly to a half bow-tie slot antenna. As illustrated in FIG. 30, the broadband antenna 100 consists of two triangular antennas 102 & 103 connected to the center of a half bow-tie slot 104, on each side of the half slot antenna 101, over a ground plane conductor 105. Both the slot and the two triangular antennas are excited by a common RF feed 106 located at the center of the half bow-tie slot 104. Each of the two triangular antennas 102 & 103 is positioned in a plane at an angle to that of the slot antenna 101.

Hence, there has been disclosed a number of novel broadband antennas that are highly efficient and compact in size. By combining a slot antenna and a dipole or monopole antenna of different configurations and sizes together in various ways, the resulting antenna exhibits a very substantial impedance bandwidth, while maintaining a compact antenna structure. Due to their compactness, these broadband antennas are practical and suitable for use in many portable communications devices that require multi-channel or broadband operations. The arrangement and configuration of each broadband antenna may be altered to operate in other frequency bands and to have wider or narrower bandwidths.

Instead of a co-axial cable, the feed may be a microstrip or a coplanar waveguide in a similar fashion to the coax. If a stripline is used, the slot radiator is made out of two parallel plates. One could feed the antenna with a balanced feedline such as a two round conductor feedline coming in normal to the dipole and in line with the slot. Any two conductor balanced feedline could then be connected. Magnetic or electrically coupled parallel antennas give the equivalent of a parallel connection. For a direct series connection, the total impedance of the antenna is very high and not normally practical. The separation of the feed points should not be so great as to severely affect the input impedance of the electric dipole. The feed point could be offset from the centre of the slot providing it does not negatively affect the input impedence. It has been found that if the feed is connected to the bow tie antenna, unfavourable results are obtained.

Immaterial modifications may be made to the preferred embodiments shown here without departing from the essence of the invention.

REFERENCES

[1] R. C. Hansen, "Fundamental Limitations in Antennas", Proceedings of the IEEE, Vol. 69, February 1981, pp. 170–182

[2] J. S. Mclean, "A Re-Examination of the Fundamental Limits on the Radiation Q of Electrically Small Antennas", IEEE Transactions on Antennas and Propagation, Vol. 44, No. 5, May 1996, pp. 672–676

[3] G. H. Brown and O. M. Woodward, "Experimentally Determined Radiation Characteristics of Conical and Triangular Antennas", RCA Review, Vol. 13, December 1952, pp. 425–452

[4] R. W. P. King, "Asymmetrically Driven Antennas and the Sleeve Dipole", Proceedings of the IRE, Vol. 38, October 1950, pp. 1154–1164

[5] R. A. Burberry, "Progress in Aircraft Aerials", The Proceedings of the IEE, Vol. 109, Part B, No. 48, November 1962, pp. 431–444

[6] J. V. N. Granger and J. T. Bolljahn, "Aircraft Antennas", Proceedings of the IRE, Vol. 43, May 1955, pp. 533–550

[7] J. D. Kraus, "Antennas", McGraw Hill, New York, 1988, Second Edition, pp. 632–642

[8] P. E. Mayes, W. T. Warren and F. M. Wiesenmeyer,"The Monopole Slot: A Small Broad-Band Unidirectional Antenna", IEEE Transactions on Antennas and Propagation, Vol. 20, No. 4, July 1972, pp. 489–493

[9] B. M. Halpern and P. E. Mayes, "The Monopole Slot as a Two-Port Diversity Antenna for UHF Land-Mobile Radio Systems", IEEE Transactions on Vehicular Technology, Vol. 33, No. 2, May 1984, pp. 76–83

[10] P. E. Mayes, "Small, Broadband, Unidirectional Antenna", U.S. Pat. No. 3,710,340, Jan. 9, 1973

[11] P. E. Mayes, "Stripline Fed Hybrid Slot Antenna", U.S. Pat. No. 4,443,802, Apr. 17, 1984

[12] E. A. Hall, "Reduced Height Monopole/Slot Antenna with Offset Stripline and Capacitively Loaded Slot", U.S. Pat. No. 4,587,524, May 6, 1986

[13] E. A. Hall, "Reduced Height Monopole/Crossed Slot Antenna". U.S. Pat. No. 4,684,953, Aug. 4, 1987

[14] E. A. Hall and G. J. Schmitt, "Monopole/Crossed Slot Single Antenna Direction Finding System", U.S. Pat. No 5,402,132, Mar. 28, 1995

We claim:

1. An antenna, comprising:

a slot antenna having a slot reactance;

a feed line conductively connected to the slot antenna; and an antenna element selected from the group consisting of an electric dipole and a monopole, the antenna element connected in parallel to the slot antenna, the antenna element having a reactance that tends to reactively cancel the slot reactance at a range of operating frequencies.

2. The antenna of claim 1 in which the feed line is conductively connected to the center of the slot.

3. The antenna of claim 2 in which the feed line is a co-axial cable with an inner conductor and an outer conductor, the slot is defined by a sheet having a slot in it, and the outer conductor is conductively connected to the sheet.

4. The antenna of claim 1 in which the feed line is selected from the group consisting of a coaxial cable, a microstrip and a coplanar waveguide.

5. The antenna of claim 1 in which the antenna element is a dipole, and the slot antenna and the dipole are separated by a low dielectric spacer.

6. The antenna of claim 1 in which the slot antenna and antenna element are oriented with the same polarization.

7. The antenna of claim 1 in which the antenna element is conductively connected to the center of the slot antenna.

8. The antenna of claim 7 in which both antennas are energized by a common coaxial feed.

9. The antenna of claim 8 in which the antenna element is positioned in a plane at an angle to or normal to the plane of the slot antenna.

10. The antenna of claim 1 in which the slot antenna and antenna element have unequal length.

11. The antenna of claim 1 in which the antenna element has low input resistance when its electrical length is an odd number of wavelengths at the operating frequency.

12. The antenna of claim 11 in which the slot antenna has low input resistance when its electrical length is an even number of half wavelengths at the operating frequency.

13. The antenna of claim 1 in which the slot antenna is a dipole and the antenna element is an electric dipole.

14. The antenna of claim 1 in which the slot antenna is a dipole and the antenna element is a an electric monopole.

15. The antenna of claim 1 in which the slot antenna is a monopole and the antenna element is an electric dipole.

16. The antenna of claim 1 in which the slot antenna is a monopole and the antenna element is an electric monopole.

17. The antenna of claim 1 in which the slot antenna and the antenna element are magnetically coupled.

18. The antenna of claim 1 in which the slot antenna and the antenna element are coupled by an electric field.

19. The antenna of claim 1 in which the slot antenna and the antenna element are electrically coupled.

* * * * *